United States Patent [19]

Tamura et al.

[11] Patent Number: 4,884,597

[45] Date of Patent: Dec. 5, 1989

[54] PILE WARP YARN TENSION CONTROL

[75] Inventors: Zenji Tamura, Kanazawa; Kenji Sakurada, Matsuto; Akihiko Nakada, Komatsu, all of Japan

[73] Assignee: Tsudakoma Corp., Ishikawa, Japan

[21] Appl. No.: 191,265

[22] Filed: May 6, 1988

[30] Foreign Application Priority Data

May 8, 1987 [JP] Japan ..... 62-111976
Aug. 21, 1987 [JP] Japan ..... 62-209063

[51] Int. Cl.[4] ..... D03D 49/10

[52] U.S. Cl. ..... 139/102; 139/25; 139/105

[58] Field of Search ..... 139/102, 25, 24, 105, 139/104, 103, 109

[56] References Cited

U.S. PATENT DOCUMENTS 4,554,951 11/1985 Hirano et al. ..... 139/105
4,564,050 1/1986 Hirano ..... 139/105 X
4,569,373 2/1986 Vogel ..... 139/25
4,721,134 6/1988 Dorman et al. ..... 139/25

FOREIGN PATENT DOCUMENTS 63-120141 5/1983 Japan .

*Primary Examiner*—Andrew M. Falik
*Attorney, Agent, or Firm*—Flynn, Thiel, Boutell & Tanis

[57] ABSTRACT

A pile warp tension controller for controlling the pile warp yarn tension control mechanism of a pile fabric loom controls the position of the tension roller of the pile warp yarn tension control mechanism or the torque acting on a tension lever supporting the tension roller according to the operating state of the pile fabric loom so that the tension of the pile warp yarns is regulated at an optimum value. The control mode of the pile warp tension controller is changed over from a tension control mode to a speed control mode in forming loops of the pile warp yarns to ensure the satisfactory formation of loops having a predetermined loop length and to prevent defective loops.

14 Claims, 9 Drawing Sheets

PILE WARP YARN TENSION CONTROL

BACKGROUND OF THE INVENTION

1. Field of the Invention

The present invention relates to a technique for positively controlling the tension of pile warp yarns on a pile loom in connection with the terry motion.

2. Description of the Prior Art

The applicant of this patent application has proposed a "Let-off Motion for a Loom" in Japanese Patent Application No. 61-268317 published as Japanese Publication No. 63-120141. This proposed let-off motion has a tension control system and a speed control system, and uses the speed control system in letting off pile warp yarns. In forming pile, the control system is changed over from the tension control system to the speed control system, and the tension roll is displaced to let off the pile warp yarns rapidly at a low tension. Consequently, loops having a predetermined length are reliably formed without omitting any loop.

In a pile loom of a moving cloth type, for example, since the warp yarns are slack while the control system is in a speed control mode in which pile warp yarns are let off rapidly at low tension, the tension of the warp yarns changes sharply in changing the control mode of the control system from a speed control mode to a tension control mode in which tension is closely regulated. Consequently, the performance of the tension control system becomes unstable temporarily due to the variation of the load after the control mode of the control system has been changed over from the speed control mode to the tension control mode. That is, the tension regulating operation of the tension control system for adjusting the warp tension to a desired value fluctuates temporarily and thereby the warp tension is caused to fluctuate about the desired value.

Furthermore, in moving the cloth fell backward to the beating position for tension control, the tension roller tends to move backward by inertia beyond a position where the tension roller should be stopped, so that the control operation of the control system fluctuates temporarily and becomes unstable. Such problems arise also in a pile loom of a moving reed type, such as a sword-beat type or a reed-beat type.

Such unstable performance of the control system is undesirable and will affect adversely to the construction of the pile.

SUMMARY OF THE INVENTION

Accordingly, it is an object of the present invention to prevent the response of the control system of a pile loom becoming unstable by braking the shiftable tension roller in changing over the control mode of the control system of the pile loom from the speed control mode to the tension control mode.

In a first embodiment of the present invention, a braking force is applied to the tension roller supporting means of a pile loom to stop the movement of the tension roller temporarily in changing over the tension roller control mode from a position control mode for speed control to a torque control mode for tension control to eliminate the influence of the speed control on the tension control. Furthermore, a braking force is applied to the tension roller supporting means to prevent the inertial overshoot of the tension roller in the process of stopping the cloth fell being moved backward, namely, the process of changing over the tension roller control mode from the torque control to the position control mode, as well as in the process of changing over the tension roller control mode from the position control mode to the torque control mode. Since a stopping force is applied to a driving source in changing over the tension roller control mode from the position control mode to the torque control mode, the control system is prevented from becoming unstable and excessive movement, namely, overshoot, of the tension roller can reliably be prevented.

However, the first embodiment is designed for pile warp yarn tension control during the operation of the loom and includes no appropriate means for pile warp yarn tension control while the loom is stopped. Accordingly, the tension roller is controlled in the same manner both while the loom is in operation and while the loom is stopped, and consequently, a force the same as that applied to the pile warp yarns while the loom is in normal operation is applied to the pile warp yarns for an extended period of time by the tension roller while the loom is stopped, and hence the loops of the pile warp yarns are liable to be broken while the loom is stopped and a failure in forming loops of pile warp yarns is liable to occur during a transient period after the loom has been restarted.

Although defective loops are formed during the weaving operation of the loom, the tension of the pile warp yarns is varied periodically corresponding to the weaving cycle of the loom and hence the ratio of defective loops to the total loops is fixed and all the loops are substantially the same in height. Therefore, the defective loops formed during the weaving operation of the loom are insignificant.

Accordingly, it is a further object of the present invention to provide a further improved pile warp yarn tension control method and an apparatus for carrying out the same capable of preventing the irregular deterioration of loops of pile warp yarn while the loom is stopped and in a transient period after the loom has been restarted.

In a second embodiment of the present invention, the desired value for controlling the tension roller of a pile warp yarn tension control mechanism is varied between the states of the loom, namely, between a state in which the loom is stopped and a state in which the loom is in operation, to vary the tension of the pile warp yarns according to the operating condition of the loom. The position of the tension roller or the torque applied to the tension lever supporting the tension roller is varied between the transient period of operation and steady state period of operation of the loom during the weaving operation of the loom to control the pile warp yarn tension according to the rotating speed of the main shaft of the loom.

During the weaving operation of the loom, the desired value for controlling the tension roller is a desired position of the tension roller, a desired torque applied to the tension lever or the combination of those desired values, which are decided selectively in relation with the weaving operation of the loom.

The above and other objects, features and advantages of the present invention will become more apparent from the following description taken in conjunction with the accompanying drawings.

DESCRIPTION OF THE PREFERRED EMBODIMENT

Figure 1:
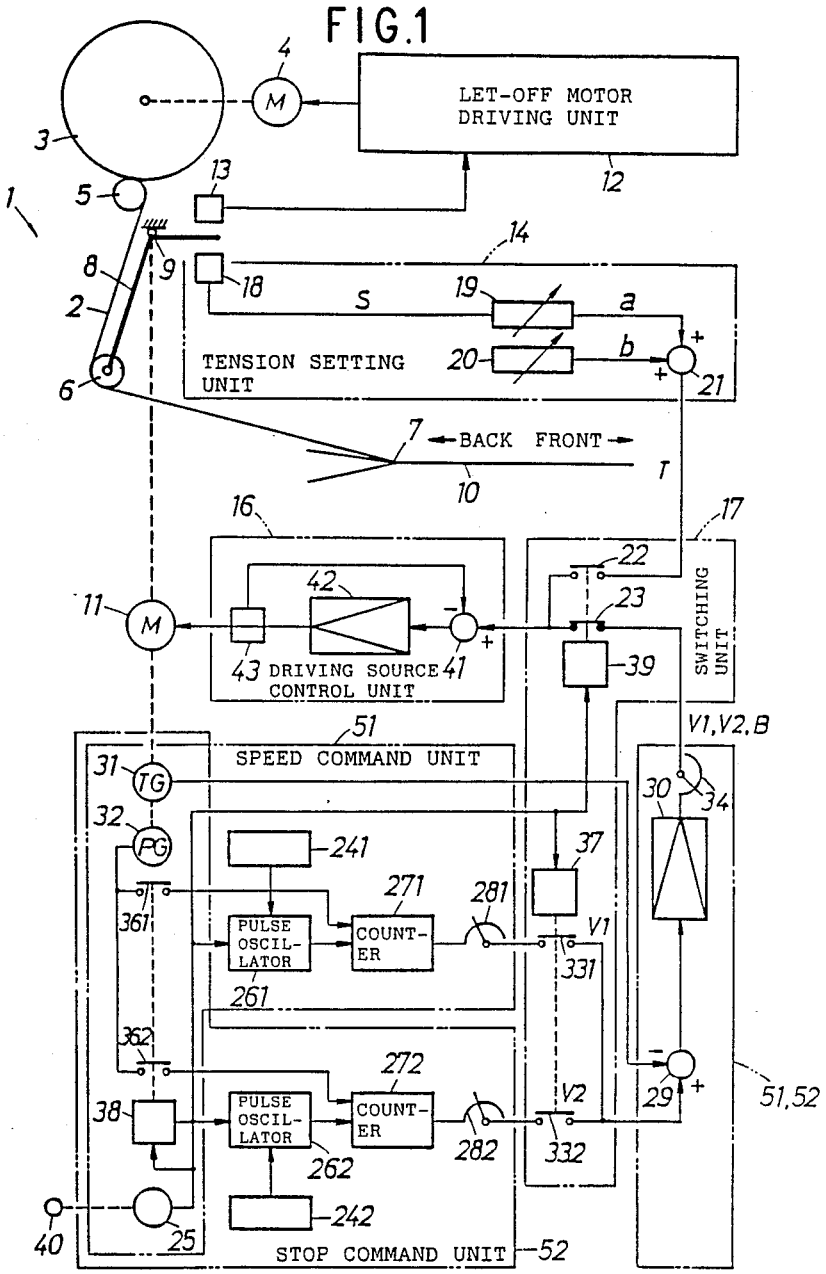
FIG. 1 is a block diagram of a pile warp yarn tension controller, in a first embodiment, according to the present invention.

In this specification, "front" is the side of the take-up motion of a loom and "back" is the side of the let-off motion of the loom, and hence "forward movement" is a movement toward the front, i.e., toward the take-up motion, of the loom, "backward movement" is a movement toward the back, i.e., toward the let-off motion, of the loom, "fast pick" is a weft yarn beaten to the cloth fell, and "loose pick" is a weft yarn beaten to a position before the cloth fell.

First Embodiment (FIGS. 1 through 4):

A pile warp yarn tension controller 1, in a first embodiment according to the present invention, will be described hereinafter with reference to FIGS. 1 through 4.

A warp of a plurality of pile warp yarns 2 is wound on a pile beam 3. The pile warp yarns 2 are let off positively by rotating the pile beam 3 by a let-off motor 4. The pile warp yarns 2 are extended around a stationary guide roller 5 and a movable tension roller 6 and are progressively fed toward the cloth fell 7 of a cloth with the progress of the weaving operation. The tension roller 6 is supported rotatably on the extremity of a tension lever 8, namely, one of the component members of a tension control mechanism, which in turn is supported fixedly at the base end thereof for swing motion on a fulcrum shaft 9 pivotally supported on the frame of a loom. The fulcrum shaft 9 is interlocked mechanically with a driving source 11 such as a rotary actuator. The driving source 11 generates a torque substantially proportional to an input current to shift the tension roller 6 through the fulcrum shaft 9 to the front or to the back so that a predetermined tension is applied to the pile warp yarns 2.

The let-off motor 4 is controlled by a let-off motor driving unit 12. The let-off motor driving unit 12 detects the displacement of the tension lever 8 by a position detector 13 and drives the let-off motor 4 on the basis of the result of detection of the position detector 13 so that the tension lever 8 is maintained constantly at a predetermined position and the pile warp yarns 2 are let off gradually toward the cloth fell 7 with the progress of the weaving operation. Ordinarily, the let-off motor driving unit 12 has response characteristics having a large time constant. Accordingly, the let-off motor driving unit 12 does not respond to the temporary variation of the tension of the pile warp yarns 2 in one weaving cycle due to a shedding motion, movement of the cloth 10 and a pile forming motion.

Figure 2:
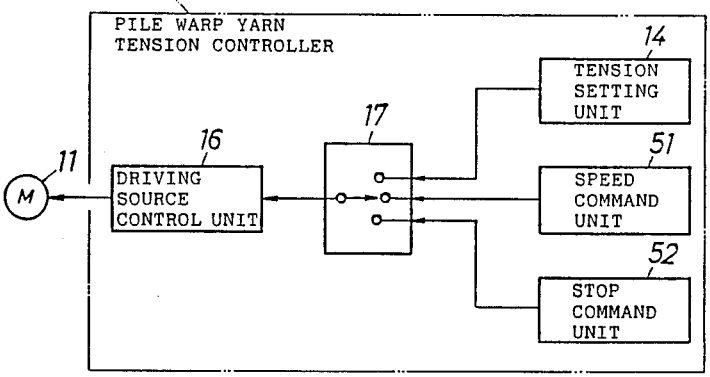
FIG. 2 is a block diagram of an essential part of the pile warp yarn tension controller of FIG. 1.

The driving source 11 is controlled by a tension setting unit 14 (tension control system), a speed command unit 51 (speed control system), a stop command unit 52, and a driving source control unit 16 which receives the output signals of the tension setting unit 14, the speed command unit 51 and the stop command unit 52. The respective outputs of the tension setting unit 14, the speed command unit 51 and the stop command unit 52 are connected to the inputs of a switching unit 17. A tension signal T and speed signals Vl and V2 of the tension setting unit 14, the speed command unit 51 and the stop command unit 52 are applied selectively to the driving source control unit 16. FIG. 2 shows the simplified conceptional connection between the tension setting unit 14, the speed command unit 51, the stop command unit 52, the switching unit 17 and the driving source control unit 16.

The tension setting unit 14 comprises a position detector 18 for indirectly detecting the position of the tension roller 6 from the position of the tension lever 8, a tension setting device 19 for setting the coefficient a of variation of tension connected to the position detector 18, and a tension setting device 20 for setting a basic tension constant b. The tension setting devices 19 and 20 are connected through a summing point 21 to a switch 22, such as an analog contactless switch, included in the switching unit 17.

The speed command unit 51 and the stop command unit 52 have pulse oscillators 261 and 262, respectively. Displacement setting devices 241 and 242 are connected respectively to the inputs of the pulse oscillators 261 and 262. A common rotation detector 25 connected to the main shaft 40 of the loom is connected to the respective inputs of the pulse oscillators 261 and 262. The respective outputs of the pulse oscillators 261 and 262 are connected respectively to the up-terminals of up-down counters 271 and 272. The outputs of the up-down counters 271 and 272 are connected respectively to speed setting devices 281 and 282, which in turn are connected respectively to the switches 331 and 332 of the switching unit 17. The switches 331 and 332 are connected through a summing point 29 to a speed signal amplifier 30 commonly for the speed command unit 51 and the stop command unit 52. The output of the speed signal amplifier 30 is connected through a voltage adjusting device 34 for setting an upper limit output voltage to the switch 23 of the switching unit 17. A tachometer generator 31 and a pulse generator 32 are connected mechanically to the driving source 11. The tachometer generator 31 is connected to the summing point 29 for negative feedback. The pulse generator 32 is connected through switches 361 and 362 to the respective down-inputs of the up-down counters 271 and 272.

The switches 331 and 332 and switches 361 and 362 are closed selectively at predetermined moments respectively by logic decode circuits 37 and 38. The inputs of the logic decode circuits 37 and 38 are connected to the rotation detector 25 to close and open the switches 331, 332, 361 and 362 at predetermined phase angles of the main shaft 40 every on turn of the main shaft.

The switches 22 and 23 of the switching unit 17 are controlled by a logic decode circuit 39 for on-off operation. The outputs of the switches 22 and 23 are connected commonly to the summing point 41 of the driving source control unit 16. The output of the summing point 41 is connected through a current amplifier 42 to the driving source 11. The output current of the current amplifier 42 is detected by a current detector 43 and is fed back to the summing point 41 as a feedback signal.

The operation of the pile warp yarn tension controller 1 will be described hereinafter.

While the loom is in operation, the cloth fell 7 advances gradually with the progress of the weaving operation, and thereby the tension of the pile warp yarns 2 is increased gradually. Consequently, the tension lever 8 is turned counterclockwise, as viewed in FIG. 1, on the fulcrum shaft 9. The position detector 13 gives an electric signal corresponding to the angular displacement of the tension lever 8 to the let-off motor driving unit 12. Then, the let-off motor driving unit 12 decides the position of the tension roller 6 from the input signal, drives the let-off motor 4 to let off the pile warp yarns 2 properly with the advancement of the cloth fell 7.

Suppose that the weave type of the pile cloth is three-weft pile weave. Then, one complete weave is formed every three picks, namely, every three turns of the main shaft 40 of the loom. In the moving cloth towel weaving operation, in which the beating position is fixed, the cloth 10 is shifted to the front and to the back to adjust the position of the cloth fell 7 relative to the beating position so that loops of a predetermined length are formed.

Figure 3:
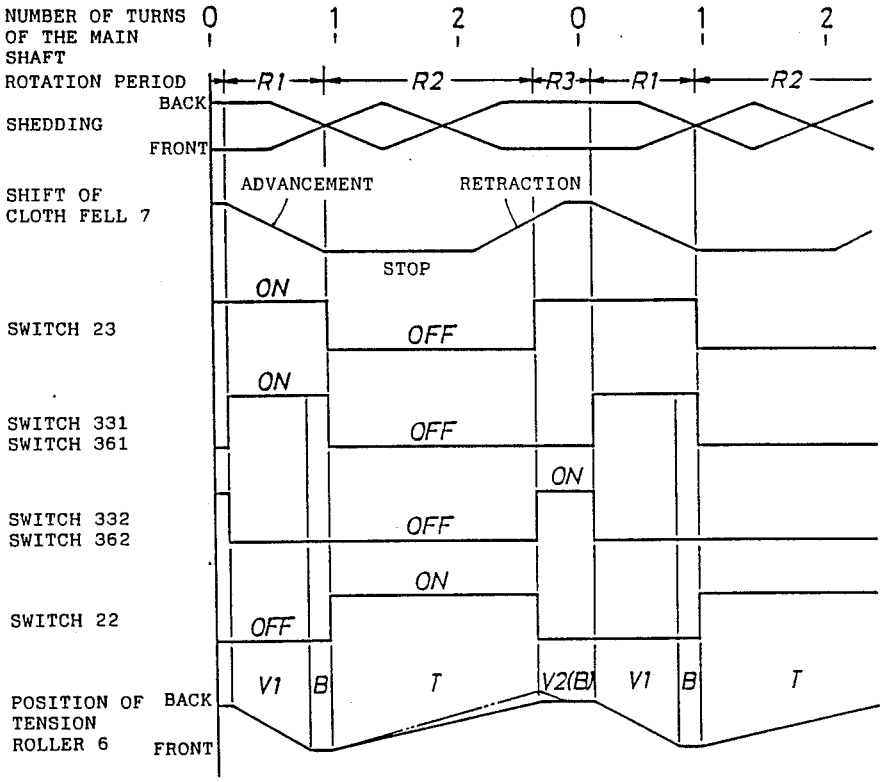
FIG. 3 is a time chart depicting signals occurring during the operation of the pile warp yarn tension controller of FIG. 1.
Figure 4:
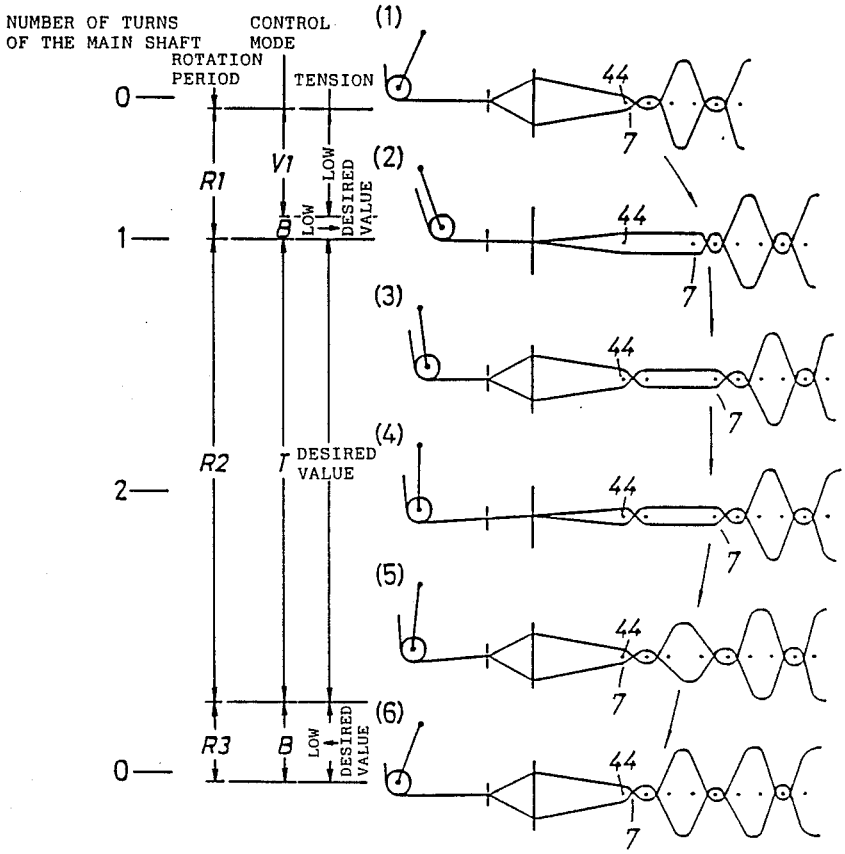
FIG. 4 is a diagram depicting the positional relation between the cloth fell and a tension roller in different stages of a weaving operation.
Figure 5:
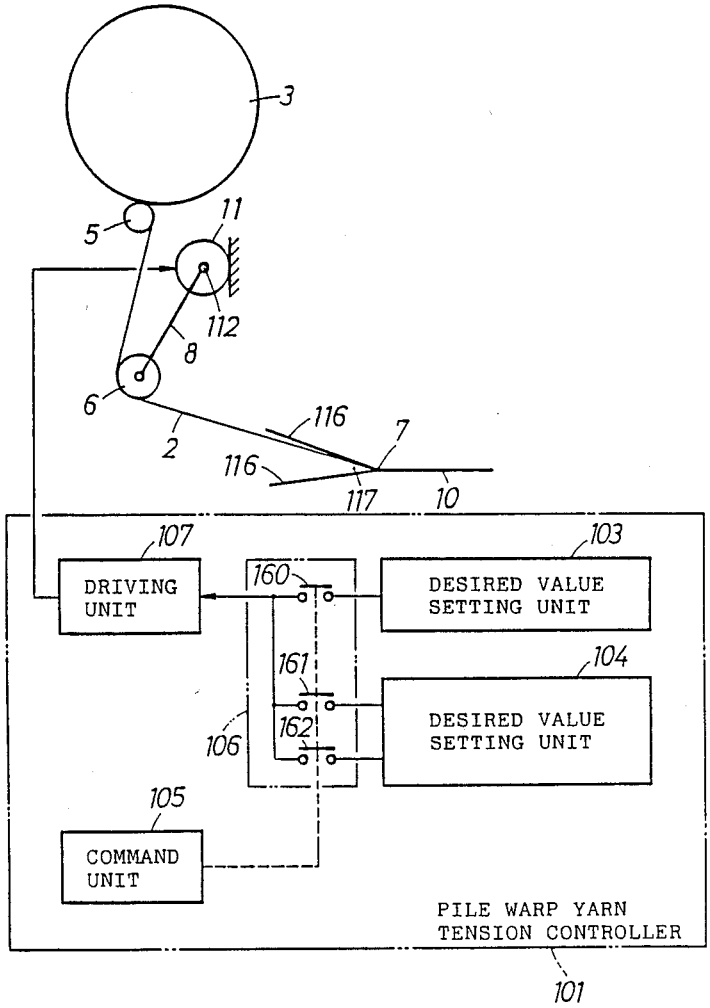
FIG. 5 is a block diagram of a pile warp yarn tension controller, in a second embodiment, according to the present invention.
Figure 6:
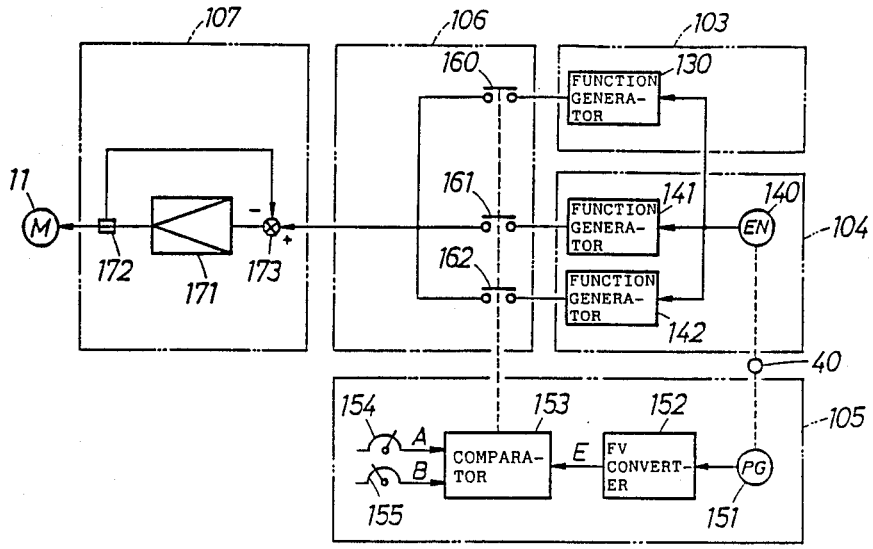
FIG. 6 is a block diagram of a first specific example of the second embodiment.
Figure 7:
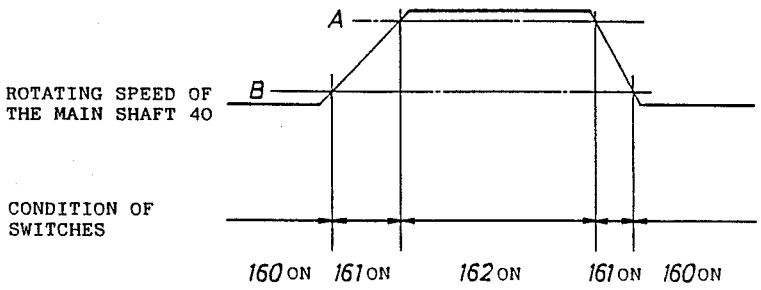
FIG. 7 is a diagram depicting a feature of the operation of the first specific example.
Figure 8:
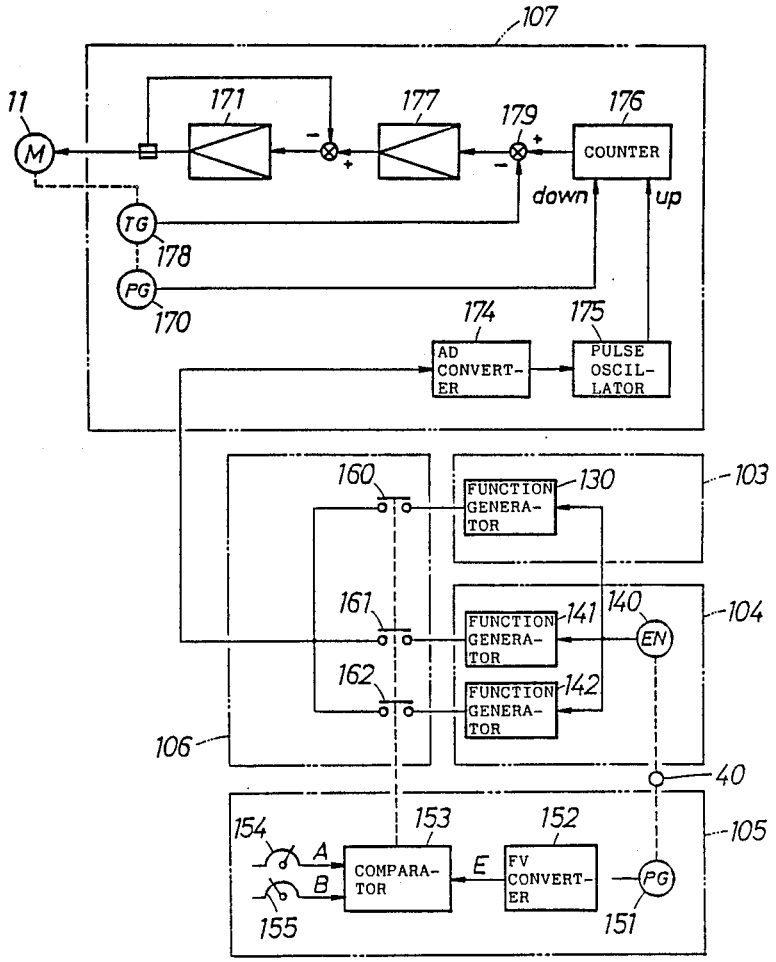
FIG. 8 is a block diagram of a second specific example of the second embodiment, which differs from the embodiment of FIG. 6 in that it has a driving unit which includes digital components.
Figure 9:
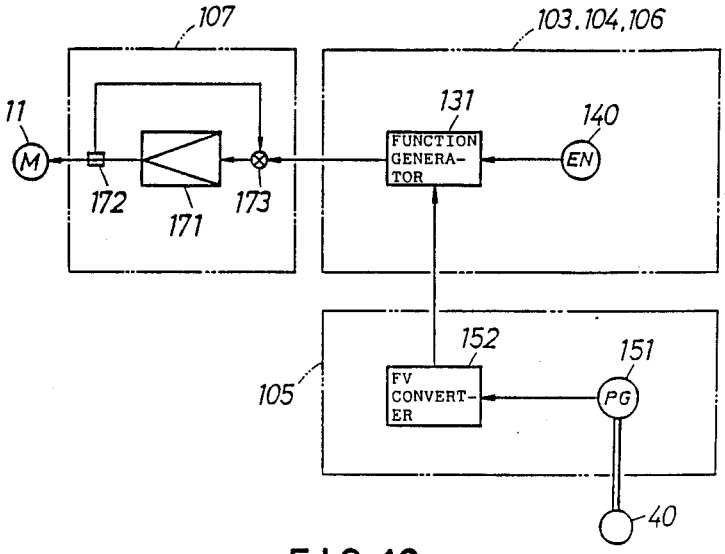
FIG. 9 is a block diagram of a third specific example of the second embodiment, which differs from the embodiment of FIG. 6 in that it has a single function generator to implement the functions of two value setting units.

FIG. 3 shows the shedding condition of the pile warp yarns 2, the shift of the cloth 10, the conditions of the switches 22, 23, 331 and 332 and the position of the tension roller 6 in connection with the number of turns of the main shaft 40 of the loom in one weaving cycle for forming one complete weave of the cloth 10. FIG. 4 shows the position of the tension roller 6 in relation to the shift of the cloth fell 7.

As obvious from the shift of the cloth 10 and loop forming operation shown in FIGS. 3 and 4, the tension of the pile warp yarns 2 varies periodically every one weaving cycle. In FIG. 4, loops are completed in a state (1), the loom operates for loose picks in states (2), (3) and (4), and the loom operates for a fast pick to form loops in states (5) and (6).

In the pile warp yarn tension controller 1, the speed command unit 51 functions as a speed control system to drive the driving source 11 during the advancement of the cloth fell 7, and then the stop command unit 52 operates. The tension setting unit 14 functions as a tension control system to control the driving source 11 so that the tension of the pile warp yarns 2 is maintained at the desired tension while the cloth fell 7 is stopped at the front position and while the cloth fell 7 is being shifted backward.

To bring the speed command unit 51, the stop command unit 52 and the tension setting unit 14 selectively into operation the logic decode circuit 39 detects the number of rotation of the main shaft 40 to close the switch 23 in rotation periods R1 and R3 of the main shaft 40, and to close the switch 22 in a rotation period R2 of the main shaft 40.

A series of control processes executed by the pile warp yarn tension controller 1 will be described hereinafter.

Tension Roller Position Control Process:

After loops have been formed, the logic decode circuits 37, 38 and 39 receive the output signal of the rotation detector 25 in the rotation period R1 to detect a predetermined moment of starting the advancement of the cloth fell 7 and close the switches 331, 361 and 23 at the predetermined moment. Similarly, the pulse oscillator 261 detects the predetermined moment of starting the advancement of the cloth fell 7 from the output signal of the rotation detector 25, and then generates pulses of a number corresponding to a predetermined forward displacement of the tension roller 6 previously set by the displacement setting device 241 and applies the pulses to the up-terminal of the up-down counter 271. Then, the up-down counter 271 counts the input pulses and gives an output proportional to the count of the input pulses to the speed setting device 281. Then the speed setting device 281 applies a speed signal V1 corresponding to the input pulses through the switch 331 and the summing point 29 to the speed signal amplifier 30. The speed signal amplifier 30 gives the speed signal Vl1after amplification to the driving source control unit 16. Then, the driving source control unit 16 generates a current corresponding to the speed signal V1 to drive the driving source 11 instantly so that the tension lever 8 is turned so as to reduce the tension of the pile warp yarns 2, and thereby the tension roller is advanced rapidly at a speed higher than the advancing speed of the cloth fell 7 from a position shown in the state (1) to a position shown in the state (2) in FIG. 4 by a distance corresponding to the distance of advancement of the cloth fell 7. Thus, the tension roller 6 is advanced prior to the advancement of the cloth fell 7 to slacken the pile warp yarns 2 temporarily. Since the tension of the pile warp yarns 2 is thus reduced to a level which will not cause defective loops, satisfactory loops are reliably formed.

Stop Position Control Process:

During the operation of the driving source 11, the pulse generator 32 generates pulses of a number corresponding to the rotating quantity of the driving source 11 and applies the pulses to the down-input of the up-down counter 271. Upon the reduction of the count counted by the up-down counter 271 to "0", the speed signal V1 applied to the driving source control unit 16 by the speed command unit 51 is interrupted, and then the stop command unit 52 applies a stop signal B corresponding to the count "0" to the driving source control unit 16 to apply a braking force to the driving source 11 to stop the rotative driving action of the driving source 11. Consequently, the tension roller 6 is stopped immediately at a predetermined position in a braked state. Then, the cloth is advanced to shift the cloth fell 7 to the predetermined front position, and thereby the pile warp yarns 2 are tightened and the tension of the pile warp yarns 2 increases to a set tension. Thus, the forward movement of the tension roller 6, hence the counterclockwise turning of the tension lever 8 (FIG. 1, FIG. 4, state (2), in response to the speed signal V1 is stopped instantly in a steady state in response to the stop signal B without inertial movement beyond the predetermined position.

Torque Control Process:

In the rotation period R2, the logic decode circuit 39 receives the output signal of the rotation detector 25, decides a cloth fell stopping moment, namely, a moment when the advancement of the cloth fell 7 is to be stopped, and then closes the switch 22 and opens the switch 23 at the cloth fell stopping moment. Consequently, a desired tension signal T is applied to the driving source control unit 16. That is, the desired tension signal T generated by the tension setting unit 14 is applied to the driving source control unit 16 when the switch 22 of the switching unit 17 is closed. The desired tension signal T is decided by the tension setting devices 19 and 20 by using an expression: $T=aS+b$, where a is a ratio for dividing a position signal S provided by the position detector 18 by the tension setting device 19 to adjust a tension variation corresponding to the position signal S provided by the position detector 18, and b is a constant corresponding to an optional basic tension set by the tension setting device 20. Thus, the desired tension signal T can be given by a general expression of a straight line: ax+b having an optional gradient a and an optional constant term b. The driving source control unit 16 receives the desired tension signal T and supplies a current corresponding to the desired tension signal T to the driving source 11 to apply a necessary torque to the fulcrum shaft 9 so that a desired tension is applied through the tension lever 8 and the tension roller 6 to the pile warp yarns 2 by the torque applied to the fulcrum shaft 9 by the driving source 11. When such a torque is applied to the fulcrum shaft 9, the tension lever 8 turns clockwise as the pile warp yarns 2 are let off from the pile warp beam 3 as shown in states (3), (4) and (5) in FIG. 4.

Stop Position Control Process:

In the rotation period R3, when the logic decode circuits 37, 38 and 39 detect the predetermined moment between the start of the backward movement of the cloth fell 7 and the stop of the cloth fell 7 at the back position, they close the associated switches 332, 362 and 23. At the same time, the pulse oscillator 262 receives the output signal of the rotation detector 25 at the just mentioned moment, and then generates pulses of a number corresponding to the predetermined displacement of the cloth fell 7 and gives the pulses to the up-input of the up-down counter 272.

When the displacement setting device 242 is set beforehand for "0", "0" is applied as the number of pulses to the up-input of the up-down counter 272 and a voltage of "0" is applied to the input of the speed amplifier 30. Then, the driving source control unit 16 stops the driving source 11 immediately and brakes the driving source 11. Consequently, the tension lever 8 being turned clockwise to apply the predetermined tension to the pile warp yarns 2 as the cloth fell 7 is moved backward in the torque control process is stopped instantly at the predetermined moment before the stop of the backward movement of the cloth fell 7, so that the pile warp yarns 2 are extended stably at the predetermined tension when the cloth fell 7 is stopped.

Thus, the weaving cycle of the loom is completed, and then the loom repeats the weaving cycle successively. Naturally, one weft yarn 44 is picked every picking cycle represented by the numbers of rotation 0, 1 and 2.

While the driving source 11 is in operation, the tachometer generator 31 generates a signal proportional to the rotating speed of the functional member of the driving source 11 and feeds back the signal to the summing point 29 to regulate the rotating speed of the functional member of the driving source 11 below a predetermined limit.

In this embodiment, the displacement setting device 242 is set, by way of example, for "0" in the rotation period R3 to brake the tension lever 8. However, if necessary, the mode of the speed control operation may be such that the tension roller 6 is moved forward, namely, in a direction to slacken the pile warp yarns 2, prior to braking the tension lever 8, because it is advantageous to apply no tension to the pile warp yarns 2 while the cloth fell 7 is being moved backward in the rotation period R3, i.e., a pile forming period. In contrast, the pile warp tension increases excessively when the tension lever 8 is simply braked and loops having a predetermined length cannot be formed or defective loops are formed, as the increment in length of pile warp yarns 2 necessary for shedding the warp pile yarns 2 is greater than the backward displacement of the cloth fell 7, namely, the loop length, in weaving a pile cloth of some weave type. Such a speed control operation preceding the braking control operation can easily be implemented by setting the displacement setting device 242 for a desired displacement. In such a case, the speed signal V2 may be the same as the speed signal V1 provided in the rotation period R1. The displacement of the tension roller 6 under such a control mode is indicated by an alternate long and two snort dashes line in FIG. 3.

Furthermore, since the respective braking periods in the rotation periods R1 and R3 are required to continue only between the end of the speed control operation or the tension control operation and the next variation of the desired tension, the respective lengths of the braking periods may be optional.

Moreover, the predetermined moments for defining the rotation periods R1, R2 and R3 may be decided optionally depending on the type of the pile cloth.

Still further, although the tension roller 6 is supported on the tension lever 8 supported for swing motion on the fulcrum shaft 9 in this embodiment, the tension roller 6 may be supported so as to be movable along guide means to the front and to the back to increase or to decrease the tension of the pile warp yarns 2.

Although this embodiment executes the position control operation, the torque control operation and the stop position control operation in combination mainly for suppressing the abrupt variation of the tension of the pile warp yarns 2 in the loop forming picking cycle, i.e., the fast pick cycle, the timing of changing over the operation between those three operations need not be limited to that of this embodiment described hereinbefore. These three operations may be implemented in combination, when necessary, in an appropriate period to suppress the temporary variation of the tension of the pile warp yarns 2 in a period other than the loop forming cycle, for example, during beating operation and/or during shedding operation.

Second Embodiment (FIG. 5 through FIG. 14):

A pile warp tension controller 101, in a second embodiment, according to the present invention is designed so as to be able to deal with weaving conditions other than the steady weaving condition. The pile warp tension controller 101 operates in cooperation with a tension control mechanism.

The pile warp yarn tension controller 101 comprises desired value setting units 103 and 104, a command unit 105, a changeover unit 106 and a driving unit 107.

The tension control mechanism has a tension roller 6 for applying a tension to pile warp yarns 2, rotatably supported on the free end of a tension lever 8. The tension lever 8 is supported at the base end thereof on the rotary shaft 112 of a driving source, such as a torque motor or a servomotor, for rotation together with the rotary shaft 112. The pile warp yarns 2 are let off in a warp from a pile warp beam 3 and are extended around a guide roller 5 and the tension roller 6 to the cloth fell 7 of a pile cloth 10. The pile warp yarns 2 are interlaced with ground warp yarns 116 and a weft yarn 117 at the cloth fell 7.

A desired value setting unit 103 for stopping and a desired value setting unit 104 for operation provide predetermined desired values according to the conditions of the loom. The desired value setting units 103 and 104 are connected through the switches 160, 161 and 162 of a switching unit 106 to the driving unit 107 of the driving source 11. The switching unit 106 is controlled by a command unit 105.

The command unit 105 decides the state of the loom, namely, a stopping state or an operating state, from the rotating speed of the main shaft of the loom, an operation signal and a stop signal; and closes the switch 160 of the switching unit 106 when the loom is stopped, closes the switch 161 of the switching unit 106 in an initial transient operating period of the weaving operation, closes the switch 162 of the switching unit 106 during the normal operation of the loom after the initial transient period, and closes the switch 161 again in stopping the loom. Accordingly, while the loom is stopped, a desired value set by the desired value setting unit 103 is applied to the driving unit 107. While the loom is in operation, either a desired value for the initial transient period or a desired value for normal operation is applied to the driving unit 107 by the desired value setting unit.

Thus, the driving unit 107 gives a desired value to the driving source 11 while the loom is stopped to regulate the torque or angular displacement of the rotary shaft 112 supporting the tension lever 8 at a value corresponding to the desired value so that the tension of the pile warp yarns 2 is adjusted at a predetermined value. Similarly, while the loom is in operation, the driving unit 107 gives a desired value to the driving source 11 in synchronism with the loop forming operation of the loom to control the torque or angular displacement of the rotary shaft 112 supporting the tension lever 8 so that the tension roller 6 is set at a predetermined position. Thus, the tension of the pile warp yarns 2 is regulated at a predetermined value in relation with the loop forming operation of the loom.

The command unit 105 identifies the operating state, namely, a transient operating state or a normal operating state, on the basis of the rotating speed of the main shaft 40 of the loom or a suitable signal while the loom is in operation, and then closes the switches 161 and 162 of the switching unit 106 selectively according to the operating state of the loom to apply the desired value corresponding to the operating state of the loom set by the desired value setting unit 104 to the driving unit 107. Consequently, the tension of the pile warp yarns 2 is varied properly between the transient operating period and the normal operating period during the loop forming operation.

Thus, the pile warp yarn tension controller 101 gives appropriate desired values respectively for the stopping period, the transient operating period and the normal operating period selectively to the tension control mechanism according to the operating state of the loom to set the tension of the pile warp yarns 2 properly according to the operating state of the loom. Accordingly, defective loops are reduced and a uniform pile weave can be formed.

Example 1 (FIGS. 6 and 7):

A desired torque according to the rotating speed, namely, the number of turns for a unit time, of the main shaft 40 of the loom is provided as a desired value.

An internal pulse generator 151 of the command unit 105 detects the rotating speed of the main shaft 40 of the loom and provides an output signal corresponding to the rotating speed of the main shaft 40. A FV converter 152 converts the output signal of the pulse generator 151 into a voltage E proportional to the rotating speed and gives the voltage E to a comparator 153. Then, the comparator 153 compares the output voltage E of the FV converter 152 with threshold values A and B provided by threshold setting device 154 and 155. The comparator 153 provides a signal to close the switch 160 when $E \leqq B$, namely, while the loom is stopped, provides a signal to close the switch 161 when $B < E < A$, namely, during the initial transient operating period, and provides a signal to close the switch 162 when $A \leqq E$, namely, during the normal operating period. Therefore, function generators 130, 141 and 142 are connected selectively to the driving unit 107 to give desired torques respectively meeting weaving conditions at different angular positions of the main shaft 40 or at different moments in one weaving cycle including several picking cycles to the driving unit 107. The current amplifier 171 of the driving unit 107 drives the driving source 11 according to the desired torque given to the driving unit 107 to apply the desired torque to the tension lever 8. A current detector 172 detects the output current of the current amplifier 171 and feeds back the result of detection to a summing point 173 for the feedback control operation of the torque control system.

Example 2 (FIG. 8):

The position of the tension roller 6 is regulated according to the rotating speed of the main shaft 40 of the loom.

An AD converter 174 included in a driving unit 107 converts the respective outputs of function generators 130, 141 and 142 into corresponding digital values. A pulse oscillator 175 converts the output digital values of the AD 174 into pulses respectively proportional to the output digital values of the AD converter 174 and applies the pulses to the up-input of an up-down counter 176. Then, the up-down counter 176 drives the speed amplifier 177 and the current amplifier 171 to drive the driving source 11, such as a pulse motor, by an angular displacement corresponding to the number of pulses. The tachometer generator 178 detects the rotating speed of the driving source 11 and feeds back the result of detection to the summing point 179. The pulse generator 170 detects the angular displacement of the driving source 11 and applies the result of detection to the down-input of the up-down counter 176. Upon the reduction of the count of the up-down counter 176 to "0", the output of the up-down counter 176 disappears, and the driving source 11 stops automatically after shifting the tension lever 8 to the desired position.

Example 3 (FIGS. 9 and 10):

A desired torque pattern is varied in proportion to the rotating speed of the main shaft 40.

A FV converter 152 gives an output voltage representing the rotating speed of the main shaft 40 of the loom to a function generator 131. Then, the function generator 131 gives an output signal proportional to the output voltage of the FV converter 152, namely, an output signal proportional to the main shaft 40 of the loom, to the driving unit 107 at an angular position of the main shaft 40 or every weaving cycle. Then, the driving unit 107 controls the output torque of the driving source 11 at a desired torque proportional to the rotating speed of the main shaft 40. Naturally, while the loom is stopped, the function generator 131 gives a desired value for the stopping state to the driving source 11. Thus, the function generator 131 functions as the switching unit 106 as well as the setting units 103 and 104.

Figure 10:
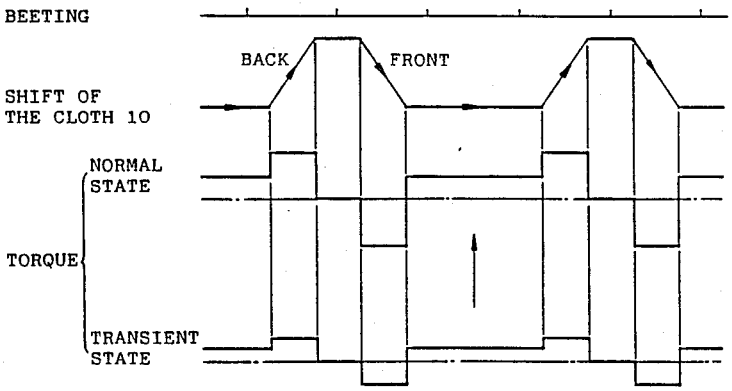
FIG. 10 is a diagram depicting signals occurring during the third specific example.
Figure 11:
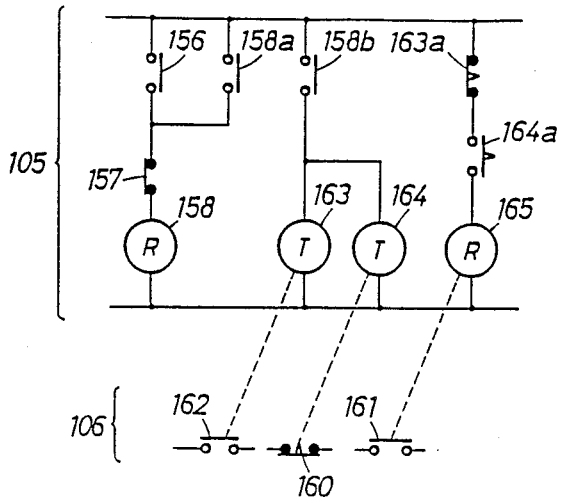
FIG. 11 is a circuit diagram of a fourth specific example of the second embodiment, which differs from FIG. 6 in that the command unit is implemented with relay logic.
Figure 12:
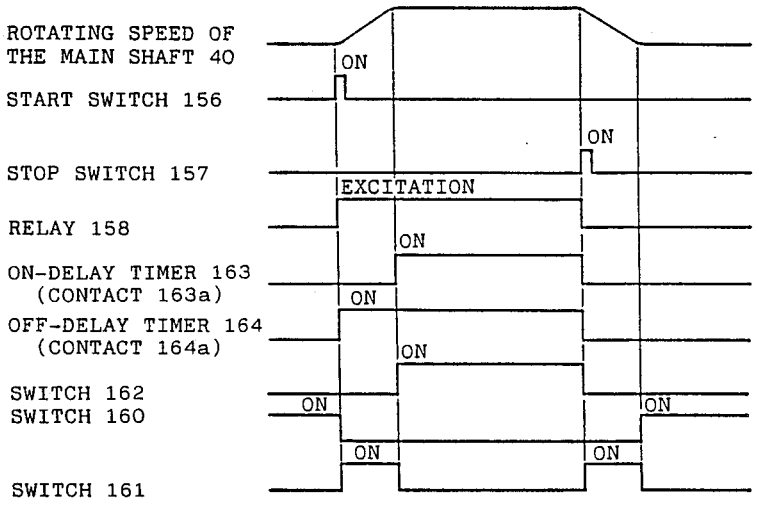
FIG. 12 is a diagram depicting signals occurring during the operation of the fourth specific example.
Figure 13:
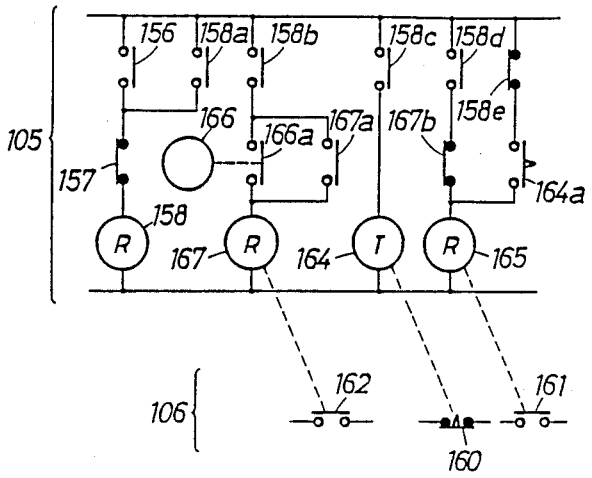
FIG. 13 is a circuit diagram of a fifth specific example of the second embodiment, which is a variation of the relay logic system of FIG. 11.
Figure 14:
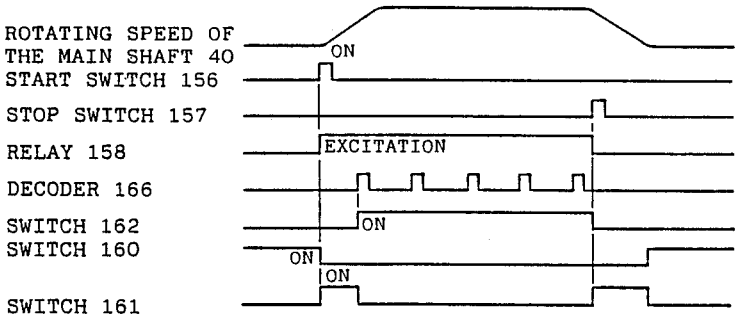
FIG. 14 is a diagram depicting signals occurring during the operation of the fifth specific example of the second embodiment.

Consequently, the pattern of torque applied to the tension lever 8 varies in proportion to the rotating speed of the main shaft 40 as shown in FIG. 10.

In this example, the loom operates in the moving cloth mode. Therefore, the desired torque is varied stepwise in synchronism with the advancement and retraction of the cloth fell 7. Accordingly, the tension of the pile warp yarns 2 is regulated properly in relation to the operation of the loom for the pile weave so that defective loops will not be formed.

Example 4 (FIGS. 11 and 12):

The switches 160, 161 and 162 are operated in relation to the operation of a start switch 156 and a stop switch 157 in a timed sequence controlled by timer means.

While the loom is stopped, the switch 160 is closed. When the start switch 156 is closed, a relay 158 is actuated to close the contacts **158*a* and 158*b* thereof, and thereby an ON-delay timer 163 and an OFF-delay timer 164 are actuated simultaneously to close the respective contacts 163*a* and 164*a* thereof respectively at moments shown in FIG. 12. During the initial transient operating period, a relay 165 holds the switch 161 closed. Upon the elapse of a time timed by the ON-delay timer 163, the switch 162 is closed by the ON-delay timer 163 to start the normal operation. When the stop switch 157 is opened during the normal operation, the OFF delay timer 164 operates for a fixed time after the stop switch 157 has been opened, and the relay 165 closes the switch 161** for the transient operation before stopping the loom.

Example 5 (FIGS. 13 and 14):

The switch 161 is controlled over the initial transient operating period in relation to the angular position of the main shaft 40. Control operation for stopping the loom is the same as that in Example 4.

When the start switch 156 is closed, the contacts **158*a*, 158*b*, 158*c* and 158*d* of a relay 158 are closed and the contact 158*e* of the relay 158 is opened to start the loom. When a decoder 166 provides a first pulse signal, a contact 166*a* is closed, and a relay 167 closes the contact 167*a* thereof and opens the contact 167*b* thereof. Thus, the switch 161 is closed during the initial operation period, and the switch 162** is closed when the normal operation is started.

In the examples described hereinbefore, except the Example 3, the initial transient operating period may be divided into a plurality of fractional periods and desired values respectively appropriate to operating modes in those fractional periods may be provided. In a weaving mode in which the rotating speed of the main shaft varies over a wide range during the normal operation, a plurality of desired values may selectively be provided according to the variation of the rotating speed of the main shaft of the loom.

Although the invention has been described in its preferred form with a certain degree of particularity, it is to be understood that many variations and changes are possible in the invention without departing from the scope thereof.

What is claimed is:

1. A pile warp yarn tension control method for a weaving operation using a tension control mechanism which has a tension roller supported for movement about a center of swing motion, the tension roller having pile warp yarns extended therearound around and the tension of the pile warp yarns extended around the tension roller changing in response to a change in the position of the tension roller, comprising:

(a) a position control step in which the tension roller is shifted forcibly in a displacement direction to a predetermined position at a desired speed in order to reduce the tension of the pile warp yarns in a time period when the tension of the pile warp yarns varies rapidly;

(b) a torque control step in which a desired torque about the center of swing motion is applied to the tension roller in order to maintain the tension of the pile warp yarns at a desired value corresponding to said desired torque; and (c) a stop position control step in which the tension roller is held stopped at a predetermined position during a predetermined period of the weaving operation.

2. A pile warp yarn tension control method according to claim 1, wherein said displacement direction is a pile warp-yarn let-off direction, wherein the forcible shift of the tension roller in the pile warp yarn let-off direction to the predetermined position at the desired speed facilitates a fast pick in said position control step, wherein the application of the desired torque about the center of swing motion of the tension roller facilitates a loose pick in said torque control step, and wherein the tension roller is held stopped at the predetermined position in said stop position control step during a time period between one of said position and torque control steps and the other thereof.

3. A pile warp yarn tension controller for controlling a tension control mechanism which is part of a loom, which has a tension roller supported so as to be able to be displaced about a center of pivotal motion and which continuously controls the tension of pile warp yarns extended around the tension roller on the basis of the variation of the position of the tension roller, comprising:

(a) a speed command unit which provides a speed signal to control shifting of the tension roller forcibly in a direction for suppressing the variation of the tension of the pile warp yarns, and first means responsive to said speed signal for causing said tension control mechanism to move said tension roller in said direction to a predetermined position at a desired speed;

(b) a stop command unit which provides a stop signal, and second means responsive to said stop signal for causing said tension control mechanism to hold the tension roller stopped at the predetermined position;

(c) a tension setting unit which provides a tension signal, and third means responsive to said tension signal for causing said tension control mechanism to apply a desired torque to the center of pivotal motion of the tension roller so as to produce a desired tension in said pile warp yarns;

(d) a switching unit which sequentially selects and outputs the speed signal from said speed command unit, the stop signal from said stop command unit and the tension signal from said tension setting unit during every weaving cycle of the loom, said switching unit effecting said sequential selections at respective predetermined angular positions of a main shaft of the loom in synchronism with the rotation of the main shaft;

(e) a driving source control unit which receives the selected one of the speed signal, the stop signal and the tension signal output by said switching unit, and which generates successive driving output signals respectively corresponding to the speed signal, the stop signal and the tension signal; and (f) a driving source which receives said driving output signals from said driving source control unit and in response thereto drives the tension control mechanism to control the tension roller according to the selected one of the speed signal, the stop signal and the tension signal, said driving source including said first means, said second means, and said third means.

4. A pile warp yarn tension controller according to claim 3, wherein said speed command unit, said stop command unit and said tension setting unit respectively provide the speed signal, the stop signal and the tension signal, which corresponds to a desired pile warp yarn tension, at respective predetermined angular positions of the main shaft of the loom in synchronism with the rotation of the main shaft of the loom, and wherein said switching unit includes means for selecting the speed signal provided by said speed command unit for a fast pick and the tension signal provided by said tension setting unit for a loose pick.

5. A pile warp yarn tension controller for controlling a tension control mechanism which is part of a loom, which has a tension roller supported so as to be able to be displaced and which controls the tension of pile warp yarns extended around the tension roller in relation to the weaving operation of the loom, comprising:

(a) a stopping condition setting unit which outputs a first signal representing a desired pile warp yarn tension value to be effected when the loom is stopped;

(b) an operating condition setting unit which outputs a second signal representing a desired pile warp yarn tension value to be effected when the loom is in weaving operation;

(c) a command unit which determines when the loom is respectively stopped and operating, and which provides a switching signal having first and second states respectively corresponding to a stopping state in which the loom is stopped and an operating state in which the loom is operating;

(d) a switching unit which in response to the switching signal respectively selects and outputs the first signal from the operating condition setting unit and the second signal from the stopping condition setting unit when the switching signal from the command unit respectively is in said first and second states;

(e) a driving source for driving the tension control mechanism; and (f) a driving unit for driving the driving source in response to the selected one of the first and second signals output by the switching unit.

6. A pile warp yarn tension controller according to claim 5, wherein the operating state of the loom includes a normal weaving state and includes a transient weaving state which is in effect during transitions between the stopping state and the normal weaving state, and wherein the second signal output by said operating condition setting unit has respective states in said transient weaving and normal weaving states which represent respective desired pile warp yarn tension values for the transient weaving state and the normal weaving state.

7. A pile warp yarn tension controller according to claim 6, wherein the tension control mechanism includes a pivotally supported lever on which the tension roller is supported, the tension control mechanism moving the lever in order to effect movement of the tension roller, and wherein the first signal from said operating condition setting unit represents at least one of a position at which the tension roller is to be positioned by the tension control mechanism and a torque which is to be applied by the tension control mechanism to the tension lever supporting the tension roller.

8. A pile warp yarn tension control method according to claim 1, wherein said position control step, said torque control step and said stop position control step are successively carried out in a predetermined order.

9. A pile warp yarn tension controller for controlling a tension control device which is part of a loom and which has a movably supported tension roller around which pile warp yarns of the loom extend, comprising:

speed command means for generating a speed signal;

tension setting means for generating a tension signal;

stop command means for generating a stop signal;

switching means for respectively selecting and outputting said speed signal, said tension signal and said stop signal during respective first, second and third periods of each pile forming cycle of the loom; and driving means responsive to said switching means for causing said tension controller to forcibly move said tension roller at a predetermined speed to a predetermined position in response to said speed signal selected by said switching means during said first period in order to reduce the tension on the pile warp yarns, for causing said tension controller to continuously apply a predetermined force to said tension roller in response to said tension signal selected by said switching means during said second period, and for causing said tension controller to hold said tension roller stationary in response to said stop signal selected by said switching means during said third period.

10. A pile warp yarn tension controller according to claim 9, wherein said stop command means includes displacement setting means for specifying a selected displacement, a counter, pulse means responsive to said displacement setting means and to rotation of a main shaft of said loom for causing said counter to be incremented from zero to a value proportional to said predetermined displacement, means responsive to movement of said tension roller for causing said counter to be progressively decremented to zero, and means for generating said stop signal as a function of the value in said counter.

11. A pile warp yarn tension controller according to claim 9, wherein said speed command means includes displacement setting means for specifying a selected displacement, a counter, pulse means responsive to said displacement setting means and to rotation of a main shaft of said loom for causing said counter to be incremented from zero to a value proportional to said predetermined displacement, means responsive to movement of said tension roller toward said predetermined position during said first period for causing said counter to be progressively decremented to zero, and means for generating said speed signal as a function of the value in said counter.

12. A pile warp yarn tension controller according to claim 9, wherein said tension setting means includes position detector means for detecting the position of said tension roller and for producing an output signal representative of the position of said tension roller, first tension setting means responsive to said output of said position detector means for producing a first signal representing the position of said tension roller, second tension setting means for producing a second signal having a predetermined value, and summing means responsive to said first and second signals for outputting a sum of said first and second signals which is said tension signal.

13. A pile warp yarn tension controller according to claim 9, wherein said tension controller includes a lever which is supported for pivotal movement about a pivot axis and which has said tension roller rotatably supported thereon at a location spaced from said pivot axis, and wherein said driving means includes a motor which is operatively coupled to said lever and controls movement of said lever about said pivot axis, movement of said lever about said pivot axis effecting said movement of said tension roller.

14. A pile warp yarn tension controller according to claim 9, wherein said switching means includes a plurality of switch means which can each selectively effect and interrupt an electrical connection between said driving means and a respective one of said speed command means, stop command means and tension setting means, said switching means further including means responsive to rotation of a main shaft of said loom for selectively successively actuating said switch means in a predetermined order at predetermined angular positions of said main shaft.

* * * * *

UNITED STATES PATENT AND TRADEMARK OFFICE

CERTIFICATE OF CORRECTION

PATENT NO. : 4 884 597

DATED : December 5, 1989

INVENTOR(S) : Zenji TAMURA et al

It is certified that error appears in the above-identified patent and that said Letters Patent is hereby corrected as shown below:

Column 12, line 39; delete "around".

Signed and Sealed this

Fifteenth Day of January, 1991

*Attest:*

HARRY F. MANBECK, JR.

*Attesting Officer*

*Commissioner of Patents and Trademarks*